US008506314B2

(12) United States Patent
Gramsamer et al.

(10) Patent No.: US 8,506,314 B2
(45) Date of Patent: Aug. 13, 2013

(54) SEALING OF SPRING-LOADED CONTACT PIN

(75) Inventors: Josef Gramsamer, Tittmoning (DE); Josef Krautenbacher, Fridolfing (DE); Anne Barbet, Teisendorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/256,265

(22) PCT Filed: Mar. 1, 2010

(86) PCT No.: PCT/EP2010/001252

§ 371 (c)(1), (2), (4) Date: Sep. 13, 2011

(87) PCT Pub. No.: WO2010/102738

PCT Pub. Date: Sep. 16, 2010

(65) Prior Publication Data

US 2012/0028489 A1 Feb. 2, 2012

(30) Foreign Application Priority Data

Mar. 13, 2009 (DE) ..... 20 2009 003 592 U

(51) Int. Cl.
*H01R 13/28* (2006.01)

(52) U.S. Cl.
USPC ..... 439/289

(58) Field of Classification Search
USPC ..... 439/289, 700, 824
See application file for complete search history.

(56) References Cited

U.S. PATENT DOCUMENTS

| | | | | |
|---|---|---|---|---|
| 3,701,965 | A * | 10/1972 | DuRocher et al. | 439/86 |
| 7,371,095 | B2 * | 5/2008 | Takahashi | 439/261 |

FOREIGN PATENT DOCUMENTS

| | | | |
|---|---|---|---|
| DE | 19930642 | A1 | 1/2001 |
| DE | 19945176 | A1 | 5/2001 |
| EP | 1071171 | A1 | 1/2001 |
| EP | 1498990 | A1 | 1/2005 |
| WO | 0122537 | A1 | 3/2001 |
| WO | 2007128728 | A1 | 11/2007 |

* cited by examiner

*Primary Examiner* — Phuong Dinh
(74) *Attorney, Agent, or Firm* — DeLio & Peterson, LLC; Robert Curcio

(57) ABSTRACT

A connector having a housing and at least one spring contact for establishing releasable electrical contacts. Each spring contact has a first contact pin axially movable, and a contact-side end facing a front side of the housing. A planar sealing element is arranged at the front side of the housing, and seals against a first predetermined fluid pressure. At least one through hole is in the sealing element within which a second contact pin is arranged. The second contact pin has a first contact-side end facing the spring contacts, and a second contact side end facing away from the front side of the housing. The second contact pin is arranged within the through hole and seals the through hole against a second predetermined fluid pressure. The first contact pin with the contact-side end mechanically hits the contact-side end of the second contact pin-establishing electrical contact.

36 Claims, 2 Drawing Sheets

SEALING OF SPRING-LOADED CONTACT PIN

This application claims priority from PCT Application No. PCT/EP2010/001252, filed Mar. 1, 2010, which claims priority from German Application No. DE 20 2009 003 592.1 filed Mar. 13, 2009.

BACKGROUND OF THE INVENTION

1. Field of the Invention

The present invention relates to a connector having a housing and having at least one spring contact arranged in the housing, in particular a pogo contact pin, for establishing electrical contacts which can be released, wherein each spring contact comprises a first contact pin which can be axially moved and having a contact-side end which faces a front side of the housing.

2. Description of Related Art

Spring-loaded contact pin connectors are used for the simultaneous establishment of one, two or more electrical contacts which each transmit an electrical signal, wherein the spring contacts provide an axial tolerance compensation. The housing is frequently designed as an external conductor in order to provide an external conductor contact with corresponding electrical or electromagnetic shielding. A penetration of a fluid, for example water, into the spring contacts leads to an undesirable impairment of the electrical and mechanical properties of the spring contacts and therefore needs to be avoided.

An arrangement of so-called pogo contact pins is known, for example, from DE 199 45 176 A1.

SUMMARY OF THE INVENTION

The invention is based on the problem of improving a connector of the aforementioned type in terms of sealing to prevent the ingress of fluids, also in the unplugged state, so that this connector can also be used and plugged and unplugged without restriction in damp or dust-laden environments without the electrical and/or mechanical properties of the connector being affected or impaired through fluid penetrating into the connector.

According to the invention, this problem is solved through a connector of the aforementioned type with the features identified in claim 1. Advantageous embodiments of the invention are described in the other claims.

In a first aspect, the present invention is directed to a connector with a housing having a front side comprising: at least one spring contact arranged in the housing for establishing electrical contacts which can be released, each spring contact including: a first contact pin axially positionable; and a contact-side end facing the front side of the housing; a sealing element covering the front side of the housing and sealing the side against a first predetermined fluid pressure, the sealing element including at least one through hole; a second contact pin arranged within the through hole, including a first contact-side end facing the spring contacts, and a second contact-side end facing away from the front side of the housing, the second contact pin arranged within the through hole such that the second contact pin seals the through hole against a second predetermined fluid pressure; the at least one through hole arranged with the second contact pin such that a first contact pin with the contact-side end mechanically strikes the first contact-side end of a second contact pin establishing electrical contact between the first and second contact pin.

The at least one spring contact may include a sleeve for receiving the first contact pin in a telescopic manner. The sleeve may also include, and may be at least partially embedded in, a dielectric.

An elastic spring element may be provided in the sleeve in such a way that this elastic spring element applies an axial force to the at least one axially movable first contact pin in the direction of the contact-side end of the first contact pin.

The at least one first contact pin may be arranged parallel to a longitudinal axis of the housing.

The connector may include a cap nut arranged on the housing and projecting beyond the front side of the housing in an axial direction.

The at least one spring contact may be held in a dielectric within the housing. The dielectric may be arranged in the housing terminating flush with the front side of the housing, and may include bores on the front face in the region of the through holes of the sealing element.

The at least one second contact pin may be rotationally symmetrical. A central section of the at least one second contact pin may be arranged within the through hole of the sealing element, and have the first and second contact-side ends of the second contact pin arranged outside of the through hole of the sealing element.

The sealing element may be disc-shaped.

The connector may include a pressing element arranged on the front side of the housing which grasps the sealing element around at least a part of its circumferential edge, and presses the sealing element axially against the front side.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
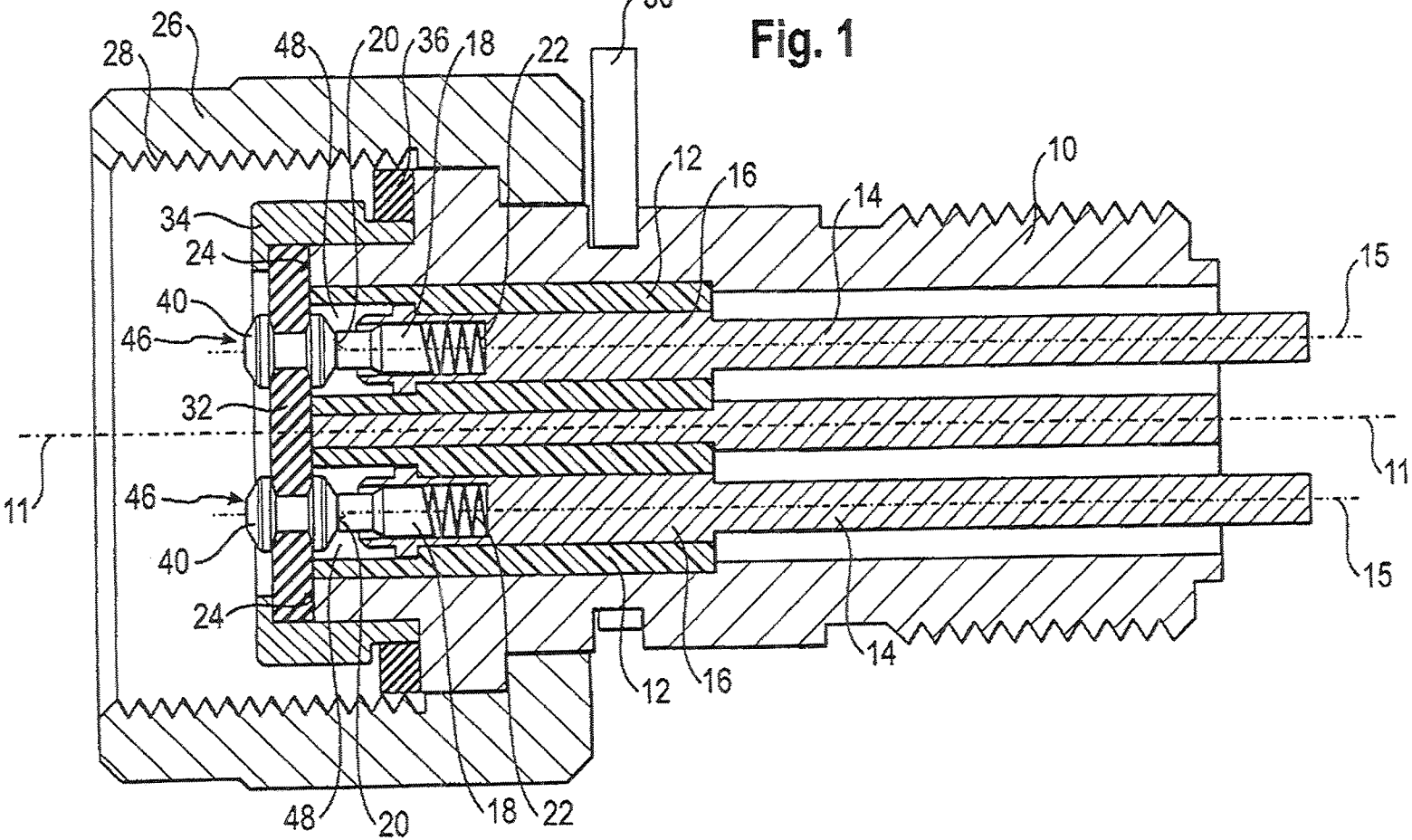
FIG. 1 shows a sectional view of a preferred embodiment of a connector according to the invention.

In describing the preferred embodiment of the present invention, reference will be made herein to FIGS. 1-3 of the drawings in which like numerals refer to like features of the invention.

According to the invention, in a connector of the aforementioned type, a planar sealing element is arranged and designed on the front side of the housing such that the sealing element covers the front side of the housing and seals it against a first predetermined fluid pressure, wherein at least one through hole is designed in the sealing element within which a second contact pin is arranged, wherein the second contact pin has a first contact-side end which faces the front side of the housing, and a second contact-side end which faces away from the front side of the housing, wherein the second contact pin is designed and arranged within the through hole in such a way that the second contact pin seals the through hole against a second predetermined fluid pressure, wherein the at least one through hole with the second contact pin is arranged in such a way that the contact-side end of a first contact pin strikes mechanically against the first contact-side end of a second contact pin in such a way that an electrical contact is created between the first and second contact pin.

This has the advantage that, even in an unplugged state, the connector is reliably sealed against the penetration of fluids or liquids into the at least one spring contact.

In a preferred embodiment, the at least one spring contact possesses a sleeve which receives the first contact pin in a telescopic manner. The sleeve is preferably at least partially embedded in a dielectric. Advantageously, an elastic spring element is provided in the sleeve in such a way that this elastic spring element applies an axial force to the at least one axially movable first contact pin in the direction of the contact-side end of the first contact pin.

Advantageously, the housing is designed as an external conductor part made from an electrically conductive material or a non-electrically conductive material.

In a preferred embodiment, the at least one first contact pin is arranged parallel to a longitudinal axis of the housing.

In order to mechanically fix the housing to a complementary connector, a cap nut is arranged on the housing and designed in such a way that the cap nut projects beyond the front side of the housing in an axial direction.

Advantageously, the at least one first spring contact is held in an insulating component within the housing.

A particularly good seal which at the same time has little effect on the axial movability and the axial tolerance compensation of the spring contacts is achieved in that the sealing element is formed of an elastically deformable material.

A free axial movement of the second contact pins, independently of one another, with simultaneous adequate support of the sealing element, is achieved in that the insulating component is arranged in the housing in such a way that the insulating component terminates flush with the front side of the housing, wherein the insulating component possesses bores on the front face in the region of the through holes of the sealing element.

In a preferred embodiment, the second contact pin is designed in such a way that this projects in an axial direction on both sides of the sealing element.

A particularly good sealing of the through hole through the second contact pin is achieved in that the second contact pin is rotationally symmetrical in design, in particular dumbbell-formed.

In a preferred embodiment, the at least one second contact pin is designed in such a way that a central section of the second contact pin is arranged within the through hole of the sealing element and the first and second contact-side ends of the second contact pin are arranged outside of the through hole of the sealing element.

Advantageously, the at least one second contact pin has a maximum outer diameter in a direction perpendicular to a longitudinal axis of the second contact pin on its first and second contact-side ends which is greater than the maximum outer diameter in the central section of the second contact pin.

In a preferred embodiment, the at least one second contact pin has a maximum outer diameter in a direction perpendicular to a longitudinal axis of the second contact pin, in a section which is arranged within the through hole of the sealing element, which is greater than the maximum inner diameter of the through hole of the sealing element. This achieves a particularly good sealing of the through hole of the sealing element through the second contact pin.

Advantageously, the sealing element is disc-formed in design.

A particularly good seal on the front side of the housing is achieved in that a pressing element is arranged on the front side of the housing which grasps the sealing element around at least a part of its circumferential edge, in particular around the entire circumferential edge, and presses it axially against the front side.

An external sealing of the connector when in its plugged-in state is achieved in that a ring-formed seal is arranged on the outer circumference of the pressing element.

Advantageously, the sealing element is made of an electrically insulating material, in particular a dielectric.

The preferred embodiment of a connector according to the invention shown in FIG. 1 comprises a housing 10 which defines a longitudinal axis 11 and in which two spring contacts 14 are held by means of a dielectric 12. Each spring contact 14 defines a longitudinal axis 15. The arrangement of two spring contacts 14 is simply exemplary; there may be only one spring contact 14 or three, four or more spring contacts 14 may be arranged in the housing 10. The spring contacts 14 are designed in the form of so-called pogo pins which each possess a sleeve 16 in which a first contact pin 18 is arranged with a contact-side end 20 being axially displaceable in a telescopic manner. A resilient element 22, for example a helical spring, is arranged within the sleeve 16 and applies force to the associated first contact pin 18 axially in relation to the sleeve 16 in the direction of the contact-side end 20. These contact pins 18 serve to establish a breakable electrical contact, wherein the contact-side end 20 forms a corresponding contact surface and the helical spring 22 generates a corresponding contact force.

The housing 10 has a front side 24 and the dielectric 12 is arranged within the housing 10 in such a way that this terminates on the front side 24 flush with the housing 10. The contact-side ends 20 of the first contact pins 18 face the front side 24 of the housing 10. A cap nut 26 with an inner thread 28 is arranged on the outer circumference of the housing 10. This serves to mechanically fix the housing 10 to a complementary connector (not shown). A securing washer 30 prevents the cap nut 26 pulling away axially from the outer circumference of the housing 10. The cap nut 26 projects in an axial direction beyond the front side 24 of the housing 10. In the embodiment shown by way of example, the housing 10 and the cap nut 26 are made of an electrically conductive material and form an outer conductor part of the connector which represents an earthing contact for the connection. The spring contacts 14 serve to transmit an electrical signal, wherein the outer conductor part 10, 26 provides a shield.

According to the invention, a sealing element 32 in the form of a disc-formed sealing mat is arranged on the front side 24 of the housing 10 which substantially covers the front side 24 completely, or over its entire surface, and lies against the front side 24 and the dielectric 12. This sealing element 32 is made of a deformable material, for example rubber, which preferably possesses electrically insulating properties. A pressing element 34 is arranged on the front side 24 of the housing 10 which grasps the sealing element 32 around its entire circumferential edge and presses axially against the front side 24. In this way the sealing element 32 seals the front side 24 against a first predetermined fluid pressure. A ring-formed seal 36 is arranged on an outer circumference of the pressing element 24 which provides a sealing of the connector in its plugged-in state.

Figure 2:
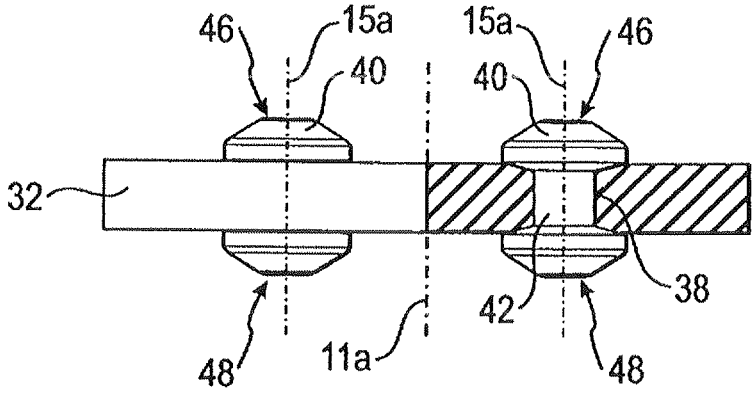
FIG. 2 shows a partially cut-away side view of a sealing element of the connector in accordance with FIG. 1.
Figure 3:
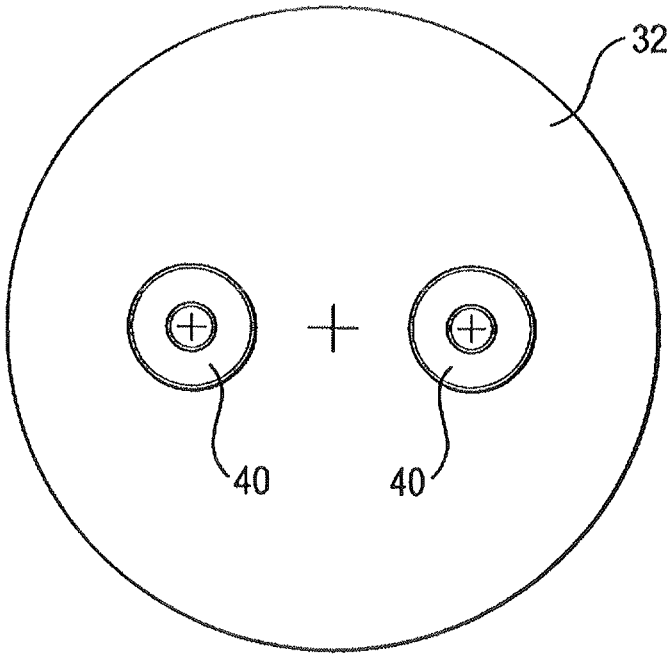
FIG. 3 shows a front view of the sealing element in accordance with FIG. 2.

The sealing element 32 is shown in more detail in FIGS. 2 and 3. The sealing element 32 possesses through holes 38, the number of which corresponds to the number of spring contacts 14 of the connector. A second contact pin 40 is arranged in each through hole 38. Each second contact pin 40 projects on each side of the sealing element 32 and possesses a central section 42 through which the bore passes, a first contact-side end 44 which faces the contact-side ends 20 of the first contact pins 18, and a second contact-side end 46 which faces away from the contact-side ends 20 of the first contact pins 18. The second contact pins 40 are rotationally symmetrical in the form of a dumbbell, so that each second contact pin 40 has a greater diameter on its first and second contact-side ends 44, 46 than in the region of the respective central sections 42. The outer diameter of the central section 42 of the second contact pins 40 is greater than an inner diameter of the through holes 38. In this way, each second contact pin 40 seals the through hole 38 through which it passes against a second predetermined fluid pressure. On the widened contact-side ends 44, 46 of the dumbbell-formed second contact pins 40, these are designed so as to widen conically on a wall facing the sealing element 32 in the direction of the contact-side ends 44, 46, as can be seen from FIG. 2. In this way, the sealing of the through hole 38 is additionally supported through a second contact pin 40. A longitudinal axis 15*a* of the second contact pins 40 is aligned with the longitudinal axis 15 (FIG. 1) of an associated first contact pin 18 (FIG. 1). A longitudinal axis 11*a* of the sealing element 32 is aligned with the longitudinal axis 11 (FIG. 1) of the housing 10 (FIG. 1).

The through holes 38 with the second contact pins 40 are arranged in such a way that in each case a first contact-side end 44 of a second contact pin 40 mechanically strikes a contact-side end 20 of a first contact pin 18. At the same time, the arrangement is such that the spring-biased element 22 presses the first contact pin 18 against the second contact pin 40. In other words, the sealing element 32 with the second contact pins 40 presses the first contact pins 18 axially into the sleeves 16 against the force of the spring-biased element 22. In this way, a functionally reliable electrical contact is established in each case between a first contact pin 18 and a second contact pin 40 with corresponding contact surface and contact pressure.

The dielectric 12 has bores 48 on the end face at those points at which the second contact pins 40 are arranged. This allows the second contact pins 40 with the corresponding section of the sealing element 32 to move independently of one another in an axial direction in the region of these bores 48, so that the axial movement of the first contact pins 18 is not significantly restricted by the sealing element 32 resting against the end face. This means that the function of axial tolerance compensation through the spring contacts 14 is fully maintained, while the penetration of fluids, for example water, into the spring contacts from the end face 24 is at the same time effectively prevented. The connector in accordance with the invention is thus also sealed when in an unplugged state.

The second contact pins 40 form an extension of the first contact pins 18, wherein the function of electrical contacting and the function of sealing the housing 10 on the end face 24 are physically and functionally separate from one another. A pre-tensioning of the spring-biased first contact pins 18 through the sealing element 32 provides a highly reliable electrical contacting. In order to prevent the spring-biased first contact pins 18 from being influenced through the sealing elements 32, the sealing element 32 lies on the bores 48 in the region of the dielectric 12. In other words, the sealing element 32 is a contact carrier with individually movable through-contacts.

The first and second predetermined fluid pressures are preferably selected so as to be identical; however, these can also be different. The lower of the two values determines the total sealing efficiency of the connector according to the invention.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A connector with a housing having a front side comprising:

at least one spring contact arranged in the housing for establishing electrical contacts which can be released, each spring contact including:

a first contact pin axially positionable; and having a contact-side end facing said front side of the housing;

a sealing element covering the front side of the housing and sealing said side against a first predetermined fluid pressure, said sealing element including at least one through hole;

a second contact pin arranged within the through hole, including a first contact-side end facing the spring contacts, and a second contact-side end facing away from the front side of the housing, said second contact pin arranged within the through hole such that the second contact pin seals the through hole against a second predetermined fluid pressure;

at least one through hole arranged with the second contact pin such that a first contact pin with the contact-side end mechanically strikes the first contact-side end of a second contact pin establishing electrical contact between the first and second contact pin.

2. The connector of claim 1 wherein the housing is designed as an external conductor part made from an electrically conductive material.

3. The connector of claim 1 wherein the at least one first contact pin is arranged parallel to a longitudinal axis of the housing.

4. The connector of claim 1 including a cap nut arranged on the housing and projecting beyond the front side of the housing in an axial direction.

5. The connector of claim 1 wherein the at least one spring contact is held in a dielectric within the housing.

6. The connector of claim 5 wherein the dielectric is arranged in the housing terminating flush with the front side of the housing, and includes bores on the front face in the region of the through holes of the sealing element.

7. The connector of claim 1 wherein the second contact pin projects in an axial direction on both sides of the sealing element.

8. The connector of claim 1 wherein the at least one second contact pin is rotationally symmetrical.

9. The connector of claim 1 including a central section of the at least one second contact pin arranged within the through hole of the sealing element, and having the first and second contact-side ends of the second contact pin arranged outside of the through hole of the sealing element.

10. The connector of claim 1 wherein the sealing element is disc-shaped.

11. The connector of claim 1 including a pressing element arranged on the front side of the housing which grasps the sealing element around at least a part of its circumferential edge, and presses the sealing element axially against the front side.

12. The connector of claim 11 including a ring-formed seal arranged on the outer circumference of the pressing element.

13. The connector of claim 1 wherein the sealing element is made of an electrically insulating material.

14. The connector of claim 1 wherein the sealing element is formed of an elastically deformable material.

15. The connector of claim 3 wherein the second contact pin projects in an axial direction on both sides of the sealing element.

16. The connector of claim 6 wherein the second contact pin projects in an axial direction on both sides of the sealing element.

17. The connector of claim 6 wherein the at least one second contact pin is rotationally symmetrical.

18. The connector of claim 8 wherein the at least one second contact pin is dumbbell-formed.

19. The connector of claim 17 wherein the at least one second contact pin is dumbbell-formed.

20. The connector of claim 6 wherein the at least one second contact pin includes a maximum outer diameter in a direction perpendicular to a longitudinal axis of the second contact pin in a section which is arranged within the through hole of the sealing element, and which is greater than the maximum inner diameter of the through hole of the sealing element.

21. The connector of claim 6 wherein the sealing element is disc-shaped.

22. The connector of claim 7 wherein the sealing element is disc-shaped.

23. The connector of claim 21 including a pressing element arranged on the front side of the housing which grasps the sealing element around at least a part of its circumferential edge, and presses the sealing element axially against the front side.

24. The connector of claim 22 including a pressing element arranged on the front side of the housing which grasps the sealing element around at least a part of its circumferential edge, and presses the sealing element axially against the front side.

25. A connector with a housing having a front side comprising:

at least one spring contact arranged in the housing for establishing electrical contacts which can be released, the at least one spring contact includes a sleeve for receiving a first contact pin in a telescopic manner, each spring contact including:

said first contact pin axially positionable; and having a contact-side end facing said front side of the housing;

a sealing element covering the front side of the housing and sealing said side against a first predetermined fluid pressure, said sealing element including at least one through hole;

a second contact pin arranged within the through hole, including a first contact-side end facing the spring contacts, and a second contact-side end facing away from the front side of the housing, said second contact pin arranged within the through hole such that the second contact pin seals the through hole against a second predetermined fluid pressure;

at least one through hole arranged with the second contact pin such that a first contact pin with the contact-side end mechanically strikes the first contact-side end of a second contact pin establishing electrical contact between the first and second contact pin.

26. The connector of claim 25 wherein the sleeve includes, and is at least partially embedded in, a dielectric.

27. The connector of claim 25 including an elastic spring element provided in the sleeve in such a way that this elastic spring element applies an axial force to the at least one axially movable first contact pin in the direction of the contact-side end of the first contact pin.

28. The connector of claim 26 including an elastic spring element provided in the sleeve in such a way that this elastic spring element applies an axial force to the at least one axially movable first contact pin in the direction of the contact-side end of the first contact pin.

29. The connector of claim 27 wherein the at least one first contact pin is arranged parallel to a longitudinal axis of the housing.

30. The connector of claim 27 including a cap nut arranged on the housing and projecting beyond the front side of the housing in an axial direction.

31. The connector of claim 28 wherein the at least one spring contact is held in a dielectric within the housing.

32. The connector of claim 27 wherein the at least one second contact pin is rotationally symmetrical.

33. The connector of claim 32 wherein the at least one second contact pin is dumbbell-formed.

34. The connector of claim 27 wherein the at least one second contact pin includes a maximum outer diameter in a direction perpendicular to a longitudinal axis of the second contact pin in a section which is arranged within the through hole of the sealing element, and which is greater than the maximum inner diameter of the through hole of the sealing element.

35. A connector with a housing having a front side comprising:

at least one spring contact arranged in the housing for establishing electrical contacts which can be released, each spring contact including:

a first contact pin axially positionable; and having a contact-side end facing said front side of the housing;

a sealing element covering the front side of the housing and sealing said side against a first predetermined fluid pressure, said sealing element including at least one through hole;

a second contact pin arranged within the through hole, including a first contact-side end facing the spring contacts, and a second contact-side end facing away from the front side of the housing, said second contact pin arranged within the through hole such that the second contact pin seals the through hole against a second predetermined fluid pressure, said second contact pin including a central section arranged within the through hole of the sealing element, and having the first and second contact-side ends of the second contact pin arranged outside of the through hole of the sealing element;

at least one through hole arranged with the second contact pin such that a first contact pin with the contact-side end mechanically strikes the first contact-side end of a second contact pin establishing electrical contact between the first and second contact pin wherein the at least one second contact pin includes a maximum outer diameter in a direction perpendicular to a longitudinal axis of the second contact pin on its first and second contact-side ends greater than the maximum outer diameter in the central section of the second contact pin.

36. A connector with a housing having a front side comprising:

at least one spring contact arranged in the housing for establishing electrical contacts which can be released, each spring contact including:

a first contact pin axially positionable; and having a contact-side end facing said front side of the housing;

a sealing element covering the front side of the housing and sealing said side against a first predetermined fluid pressure, said sealing element including at least one through hole;

a second contact pin arranged within the through hole, including a first contact-side end facing the spring contacts, and a second contact-side end facing away from the front side of the housing, said second contact pin arranged within the through hole such that the second contact pin seals the through hole against a second predetermined fluid pressure;

at least one through hole arranged with the second contact pin such that a first contact pin with the contact-side end mechanically strikes the first contact-side end of a second contact pin establishing electrical contact between the first and second contact;

wherein the at least one second contact pin includes a maximum outer diameter in a direction perpendicular to a longitudinal axis of the second contact pin in a section which is arranged within the through hole of the sealing element, and which is greater than the maximum inner diameter of the through hole of the sealing element.

* * * * *